US005343966A

United States Patent [19]

Wenzel et al.

[11] Patent Number: 5,343,966

[45] Date of Patent: Sep. 6, 1994

[54] ADJUSTABLE BENT HOUSING

[75] Inventors: Kenneth H. Wenzel; Dean Foote, both of Edmonton, Canada

[73] Assignee: Vector Oil Tool Ltd., Canada

[21] Appl. No.: 898,003

[22] Filed: Jun. 16, 1992

[51] Int. Cl.[5] ..... F21B 7/08; F21B 17/042

[52] U.S. Cl. ..... 175/74; 175/320; 285/184

[58] Field of Search ..... 175/320, 61, 73, 74, 175/256; 285/118, 93, 184

[56] References Cited

U.S. PATENT DOCUMENTS

| | | | |
|---|---|---|---|
| 1,850,403 | 3/1932 | Lee . | |
| 3,586,116 | 6/1971 | Tiraspolsky | 175/74 |
| 3,717,208 | 2/1973 | Anderson | 175/74 |
| 4,077,657 | 3/1978 | Trzeciak | 285/184 |
| 4,220,214 | 9/1980 | Benoit | 175/61 |
| 4,258,800 | 3/1981 | Hipp | 175/61 |
| 4,596,294 | 6/1986 | Russell | 175/74 |
| 4,694,914 | 9/1987 | Obrecht | 175/74 X |
| 4,745,982 | 5/1988 | Wenzel | 175/74 |
| 4,811,798 | 3/1989 | Falgout, Sr. et al. | 175/73 |
| 4,813,497 | 3/1989 | Wenzel | 175/74 |
| 4,843,945 | 7/1989 | Dinsdale | 81/57.34 |
| 4,913,466 | 4/1990 | Becker | 285/24 |
| 5,052,501 | 10/1991 | Wenzel et al. | 175/74 |
| 5,094,305 | 3/1992 | Wenzel | 175/74 |
| 5,101,915 | 4/1992 | Witte | 175/74 |

OTHER PUBLICATIONS

Publication by Eastman Christensen–Adjustment of the AKO–SUB Aug. 1990.

*Primary Examiner*—David J. Bagnell

*Attorney, Agent, or Firm*—Davis, Bujold & Streck

[57] ABSTRACT

An adjustable bent housing consisting of three tubular members arranged in end to end relation. Each of the tubular members has an interior bore. A first tubular member has a first axis. A second tubular member has a second axis. A central tubular member is centrally disposed between the first tubular member and the second tubular member and has a third axis. An internal tubular member extends into and engages the interior bores of the three tubular members thereby maintaining the tubular members in end to end relation.

1 Claim, 3 Drawing Sheets

PRIOR ART

ADJUSTABLE BENT HOUSING

BACKGROUND OF THE INVENTION

Bent subs are used when earth drilling with downhole motors. There are used to create a bend which results in the bore hole deviating from vertical. In order to avoid having a plurality of bent subs on site, adjustable bents subs were developed in which the magnitude of the bend was adjustable.

There are presently two alternative ways of constructing an adjustable bent sub. One alternative construction is exemplified by U.S. Pat. No. 4,077,657 which issued to Kurt H. Trzeciak. The Trzeciak adjustable bent sub has two tubular members in end to end relation. The two tubular members meet at a mating end formed with respect to a common mating plane which is at an angle to the axis of the part. Means is provided to lock the tubular members to each other at selected angular rotation of the ends with respect to each other. In other words, the angular adjustment is accomplished through angularly offset mating faces. Another alternative construction is exemplified by U.S. Pat. No. 4,813,497 which issued to Kenneth Hugh Wenzel. The Wenzel patent has one tubular member which is telescopically received in a second tubular member. Each of the tubular members is "bent" having a primary axis and a secondary axis. Angular adjustment is accomplished by relative rotation of the tubular members. The tubular members may be rotated to offset the "bends" so the opposed ends of the tubular members are parallel or rotated to create a cumulative bend.

As the art of horizontal and directional drilling evolved, it was determined that the preferred placement of the adjustable bend housing was as close to the drill bit, as possible. Drilling motors operate in an eccentric motion in response to mud pumped from on surface pumps. The bearing assemblies are used to rotate the drill but in a concentric motion. A universal joint type of drive shaft connects the drilling motor and the bearing assembly and is used to convert the eccentric motion of the drilling motor to a concentric motion of the bearing assembly which rotates the drill bit. U.S. Pat. No. 4,813,497 which issued to Kenneth Hugo Wenzel was the first adjustable bent housing which could be placed over the connecting drive shaft between the drilling motor and the bearing assembly. The distinction between an adjustable bent sub and an adjustable bent housing is the ability of the tool to accommodate a universal joint type of drive shaft through its central bore.

An adjustable bent housing is subjected to friction where it comes into contact with the side wall of the borehole. With each of the above described constructions of adjustable bent housing problems are encountered due to contact with the side wall of the borehole. The Wenzel design has one tubular member with an exterior neck portion on which a locking nut is positioned. This neck can break due to the force of friction when the bend of the adjustable bent housing comes into contact with the side wall of the borehole. The Trzeciak design would require significant modification before it could be used as a housing. Even with those modifications, having the entire adjustment occurring on one common plane requires more rotational clearance and therefore exacerbates the problem of friction against the sidewall of the borehole.

Some friction between the body of the adjustable bent housings and the sidewall of the borehole is unavoidable, therefore means must be found to strengthen the adjustable bent housing.

SUMMARY OF THE INVENTION

What is required is an alternate construction of Adjustable Bent Housing that has greater strength than adjustable bent housings known in the prior art.

According to the present invention there is provided an adjustable bent housing which is comprised of three tubular members arranged in end to end relation. Each of the tubular members has an interior bore. A first tubular member has a first axis. A second tubular member has a second axis. A central tubular member is centrally disposed between the first tubular member and the second tubular member and has a third axis. The first axis and the second axis are offset from the third axis. Adjustment is effected by rotating at least one of the first tubular member and the second tubular member in order to alter the positioning of the first axis or the second axis relative to the third axis. An internal tubular member extends into and engages the interior bores of the three tubular members thereby maintaining the tubular members in end to end relation with the axes in a predetermined relative position.

Although beneficial result may be obtained through the use of the adjustable bent housing as described above, there is an engagement between the internal tubular member and the interior bore of the three tubular members that is preferred over the use of internal retaining nuts as is known in the art. In this preferred embodiment the internal tubular member has an external surface, a first end and a second end. Spline extend radially outwardly from the external surface of the internal tubular member intermediate the first end and the second end and threads are positioned on the external surface adjacent the first end and the second end. The first tubular member has a first end face and an interior bore. The interior bore of the first tubular member has interior threads adjacent the first end face such that the first tubular member is adapted to threadedly engage the first end of the interior tubular member. The second tubular member has a second end face and an interior bore. The interior bore of the second tubular has interior threads adjacent the second end face such that the second tubular member is adapted to threadedly engage the second end of the interior tubular member. The central tubular member has an interior bore, a first end and a second end. The central tubular member telescopically receives the interior tubular member and is axially moveable between the first end and the second end of the interior tubular member. The interior bore of the central tubular member has spline extending radially inwardly, such that the spline mates with spline on the exterior surface of the interior tubular member to non-rotatably couple the interior tubular member with the central tubular member. At least one of the ends of the central tubular member has a mating clutch engagement with at least one of the first end of the first tubular member and the second end of the second tubular member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1A:
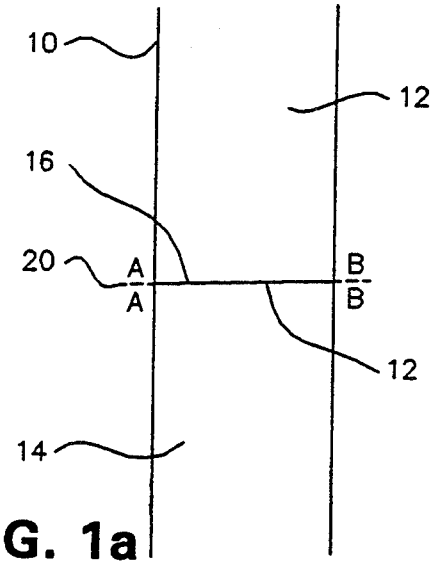
FIG. 1a PRIOR ART
FIG. 1*a* is a simplified diagrammatic representation of a prior art mode of adjustment as exemplified by Trzeciak in a straight orientation.

The preferred embodiment, an Adjustable Bent Housing, generally identified by reference numeral 30, will now be described with reference to FIGS. 3*a*, 3*b*, and 4. Prior to describing the invention the Prior Art will be described as illustrated in FIG. 1*a*, 1*b*, 2*a* , and 2*b*.

Figure 1B:
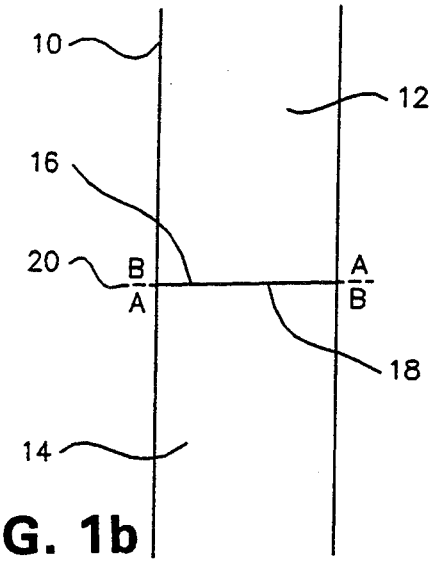
FIG. 1b PRIOR ART
FIG. 1*b* is a simplified diagrammatic representation of a prior art mode of adjustment as exemplified by Trzeciak in a bent orientation.

FIGS. 1*a* and 1*b* are simplified versions of the mode of adjustment taught by Trzeciak. The essence of the teachings of Trzeciak is that by cutting a single length of pipe 10 at an angle two tubular members 12 and 14 are created. Tubular members 12 and 14 have end faces 16 and 18, respectively, which mate on a common plane 20. For the purposes of illustration the relative rotational positioning of tubular members 12 and 14 are designated by the notation A-B. When tubular members 12 and 14 are maintained in one orientation the overall result is that pipe 10 is straight as illustrated in FIG. 1*a*. When tubular member 12 is rotated 180 degrees the overall result is that pipe 10 is "bent" as illustrated in FIG. 1*b*.

Figure 2A:
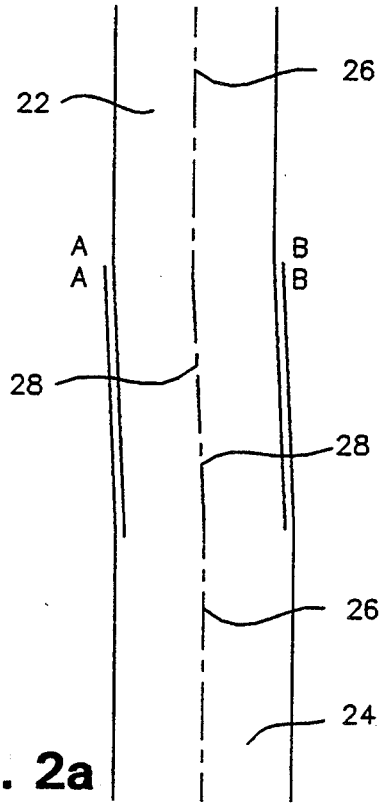
FIG. 2a PRIOR ART
FIG. 2*a* is a simplified diagrammatic representation of a prior art mode of adjustment as exemplified by Wenzel in a straight orientation.
Figure 2B:
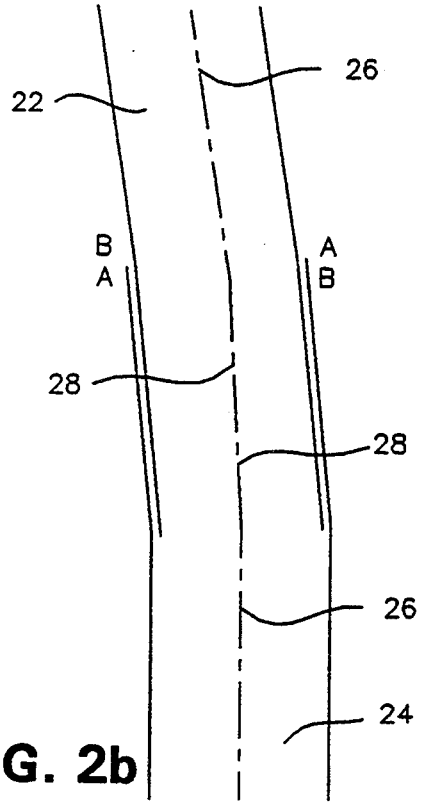
FIG. 2*b* is a simplified diagrammatic representation of a prior art mode of adjustment as exemplified by Wenzel in a bent orientation.

FIGS. 2*a* and 2*b* are simplified versions of the mode of adjustment taught by Wenzel. The essence of the teachings of Wenzel is that by telescopically mating two tubular members 22 and 24 which are already angularly offset, a "bend" can be created which is adjustable by relative rotation of tubular members 22 and 24. In FIG. 2*a* and 2*b* the bend has been exaggerated. Each of tubular members 22 and 24 is "bent", having a primary axis 26 and a secondary axis 28. Angular adjustment is accomplished by relative rotation of tubular members 22 and 24, which is designated by the notation A-B. In FIG. 2*a*, tubular members 22 and 24 have been rotated to offset the "bends" so the primary axes 26 of tubular members 22 and 24 are parallel. In FIG. 2*b*, tubular members 22 and 24 have been rotated 180 degrees to create a cumulative bend.

Figure 3A:
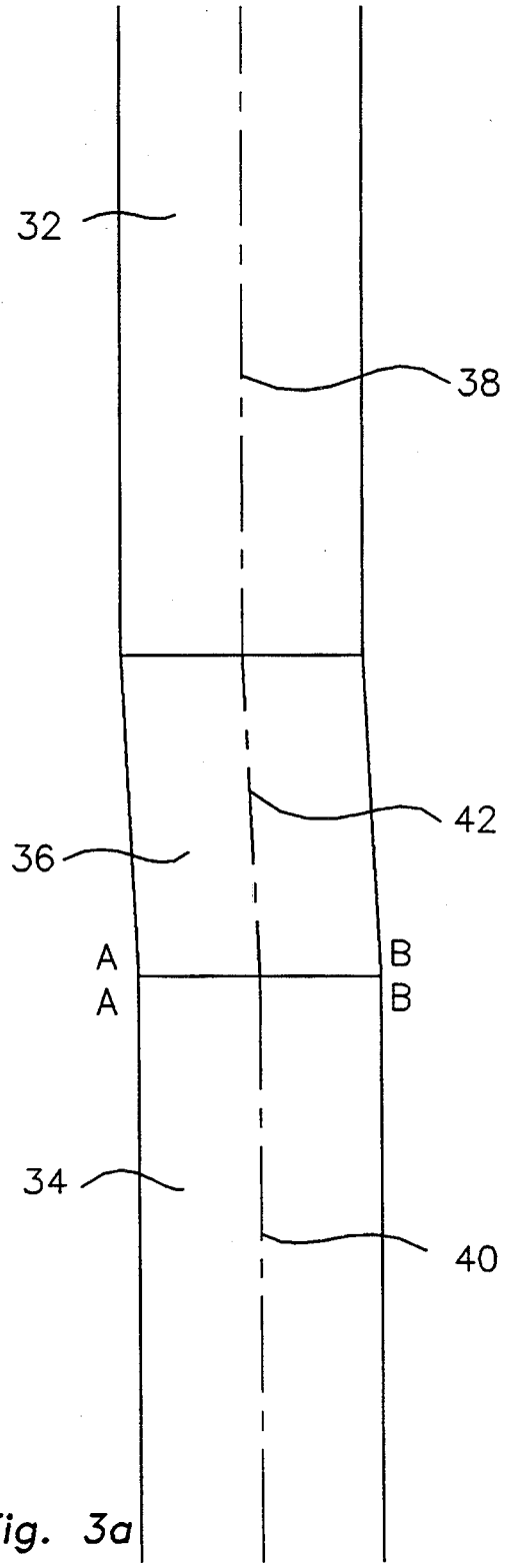
FIG. 3*a* is a simplified diagrammatic representation of the present invention in a straight orientation.
Figure 3B:
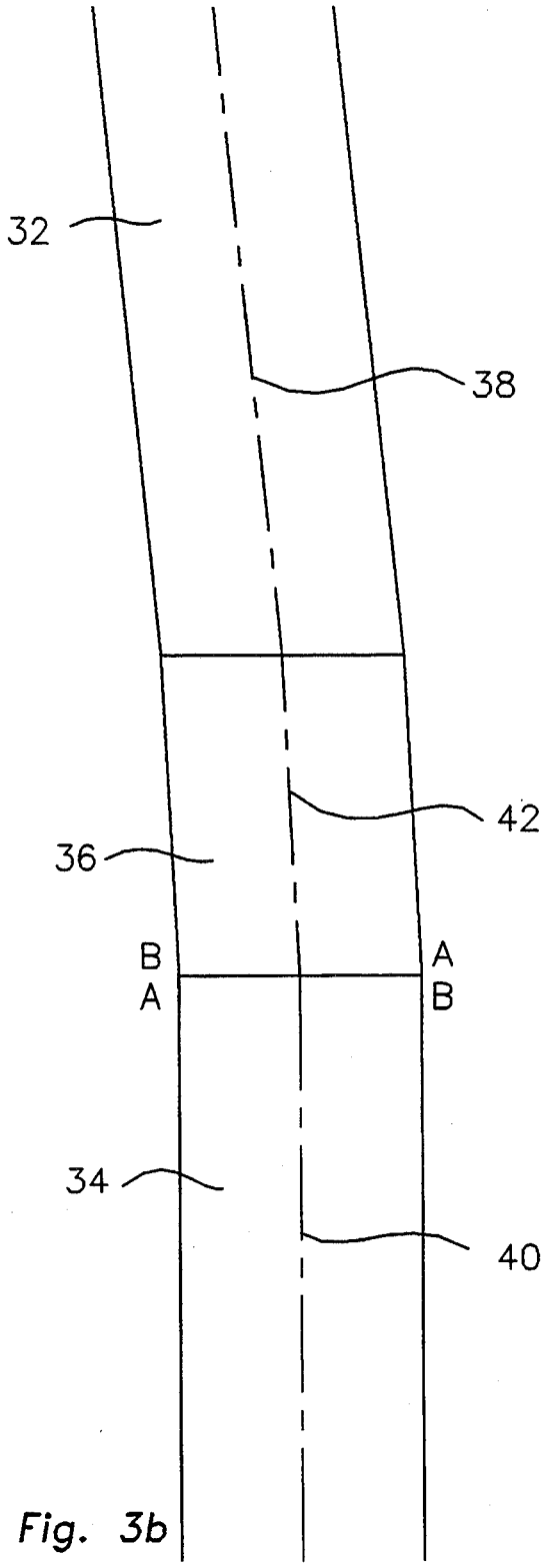
FIG. 3*b* is a simplified diagrammatic representation of the present invention in a bent orientation.

The basic principle behind adjustable bent housing 30 is illustrated in FIGS. 3*a* and 3*b*. Adjustable bent housing 30 consists of three tubular members, which will hereinafter be identified as first tubular member 32, second tubular member 34, and central tubular member 36, arranged in end to end relation. First tubular member 32 has a first axis 38. Second tubular member 34 has a second axis 40. Central tubular member 36 is centrally disposed between first tubular member 32 and second tubular member 34 and has a third axis 42. First axis 38 and second axis 40 are not coaxial with third axis 42, but rather are offset from third axis 42 by approximately $1\frac{1}{2}$ degrees, thereby creating a "bend". Adjustment of the "bend" is effected by rotating first tubular member 32, second tubular member 34 or both in order to alter the positioning of first axis 38 or second axis 40 relative to third axis 42. FIG. 3*a* illustrates adjustable bent housing 30 in a straight position. FIG. 3*b* illustrates adjustable bent housing 30 in a bent position.

The mode of maintaining tubular members 32, 34, and 36 in end to end relation with axes 38, 40, and 42 in a predetermined relative position is not illustrated in FIGS. 3*a* and 3*b*. Referring to FIG. 4, each of the tubular members 32, 34, and 36 has an interior bore 44, 46, and 48, respectively. Tubular members 32, 34, and 36 are held together by an internal tubular member 50 which extends into and engages interior bores 44, 46, and 48 of tubular members 32, 34, and 36. There are a number of ways of configuring adjustable bent housing 30 in accordance with the teachings of the invention. The preferred embodiment will now be described with reference to FIG. 4.

Figure 4:
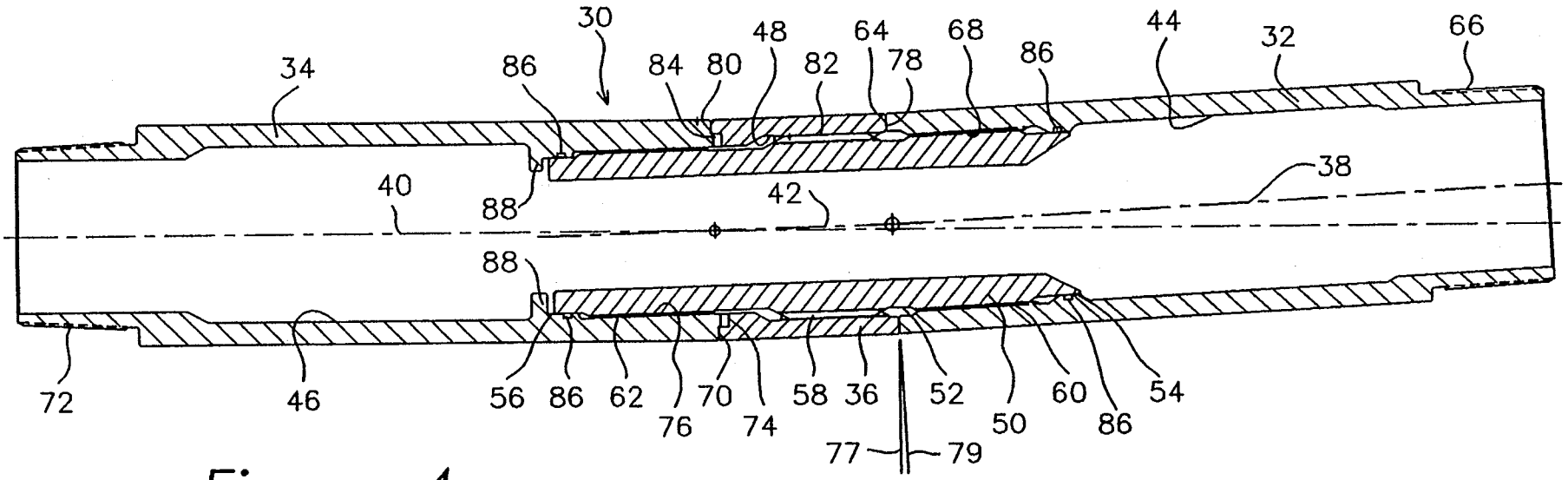
FIG. 4 is a longitudinal section view of an adjustable bent housing constructed in accordance with the teachings of the present invention.

Referring to FIG. 4, internal tubular member 50 has an external surface 52, a first end 54 and a second end 56. Spline 58 extends radially outwardly from external surface 52 of internal tubular member 50 intermediate first end 54 and second end 56. Threads 60 are positioned on external surface 52 adjacent first end 54. Threads 62 are positioned on external surface 52 adjacent and second end 56. First tubular member 32 has a first end face 64 and an opposed pin connection 66. Interior bore 44 of first tubular member 32 has interior threads 68 adjacent first end face 64 such that first tubular member 32 is adapted to threadedly engage threads 60 at first end 54 of interior tubular member 50. Second tubular member has a second end face 70 and an opposed pin connection 72. A portion of second end face 70 has a projecting clutch profile 74. Interior bore 46 of second tubular member 34 has interior threads 76 adjacent second end face 70 such that second tubular member 34 is adapted to threadedly engage threads 62 at second end 56 of interior tubular member 50. Central tubular member 36 has a first end 78 and a second end 80. Central tubular member 36 telescopically receives interior tubular member 50 and is axially moveable between first end 54 and second end 56 of interior tubular member 50. Interior bore 48 of central tubular member 36 has spline 82 extending radially inwardly, such that spline 82 mate with spline 58 on exterior surface 52 of interior tubular member 50 to non-rotatably couple interior tubular member 50 with central tubular member 36. A portion of second end 80 of central tubular member 36 has a clutch profile 84 which matingly engages clutch profile portion 74 at second end 70 of second tubular member 34. Seals 86 along external surface 52 of internal tubular member 50 adjacent ends 54 and 56 to preclude the passage of drilling fluids into that portion of adjustable bent housing 30 where threads 60 and 62 engage threads 68 and 76, respectively. Shoulders 88 project into interior bore 46 of second tubular member 34 the function of which will be hereinafter further described in relation to the operation of adjustable bent housing 30.

It was previously noted that first axis 38 and second axis 40 are offset from third axis 42. In the preferred embodiment illustrated in FIG. 4 first axis 38 has been offset from third axis 42 by machining first end 78 of central tubular member 36 at an angle of $1\frac{1}{2}$ degrees off being perpendicular to axis 42. This is illustrated in FIG. 4 by a transverse axis, identified by reference numeral 77, which is perpendicular to axis 42, as compared to a transverse axis line, identified by reference numeral 79, which is offset from axis 42 by 1½ degrees. When first tubular member 32 is placed in end to end relation with central tubular member 36, first end face 64 of first tubular member 32 engages first end 78 of central tubular member 36. First end 78 being offset by 1½ degrees in the manner described results in first tubular member 32 being offset by 1½ degrees. To accommodate this 1½ degree offset, first end 54 of internal tubular member 50 which holds first tubular member 32 and central tubular member 36 together in end to end relation is also offset by 1½ degrees in the area of threads 60. Second axis 40 is offset from third axis 42 by machining the outer diameter of second tubular member 34 in an eccentric fashion so that it is offset from second end face 70 and interior bore 46 by 1½ degrees. Therefore, when second tubular member 34 is in end to end relation with central tubular member 36 with second end face 70 of second tubular member 34 engaging second end 80 of central tubular member 36 second tubular member 34 extends at an angle of 1½ degrees and axis 40 is offset by 1½ degrees.

The use and operation of adjustable bent housing 30 will now be described with reference to FIGS. 3*a*, 3*b*, and 4. In order to adjust the bend in adjustable bent housing 30, first tubular member 32 is rotated while internal tubular member 50 is maintained stationary thereby resulting in threads 68 partially backing out of engagement with threads 60 at first end 54 of internal tubular member 50. The threads are backed off to permit central tubular member 36 to move axially along internal tubular member 50 until clutch profile 84 at second end 80 of central tubular member 36 disengages clutch profile 74 at second end 70 of second tubular member 34. As long as clutch profiles 74 and 84 remain engaged second tubular member 34 cannot be rotated, for second tubular member is locked to central tubular member 36. Central tubular member 36 is, in turn, non-rotatably coupled to internal tubular member 50 by the mating of radially inwardly extending spline 82 on interior bore 48 of central tubular member 36 with radially outwardly extending spline 58 on exterior surface 52 of interior tubular member 50. However, once the respective clutch profiles have been disengaged second tubular member 34 can be rotated in relation to central tubular member 36. The rotation of second tubular member 34 adjusts the relative positioning of axes 38, 40 and 42. Depending upon this relative positioning of the two 1½ degree offsets represented by axes 38 and 40 the result can be a cumulative "bend" of 3 degrees, a cancelling of the offsets for a "bend" of 0 degrees, or a range of positions inbetween. Maximum thread engagement between threads 62 at second end 56 of internal tubular member 50 and threads 76 adjacent second end face 70 of second tubular member 34 is desirable. To facilitate this shoulders 88 have been provided. In making an adjustment second tubular member 34 is first tightened onto second end 56 of internal tubular member 50 until second end 56 engages shoulders 88. Second tubular member 34 is then rotated, backwards or left hand, until axes 38, 40, and 42 are in the desired position. Then central tubular member 36 is slid axially along internal tubular member 50 until clutch profile 84 is back in engagement with clutch profile 74. This prevents further rotation of second tubular member 34 to maintain the adjustment. Then first tubular member is rotated to bring threads 68 into maximum engagement with threads 60 and tightly draw together second end face 70 with second end 80 and first end face 64 with first end 78 to maintain tubular members 32, 34, and 36 in end to end relation. Seals 86 prevent drilling fluids from contaminating the threads or spline when adjustable bent housing 30 is being used downhole.

It will be apparent to one skilled in the art that the adjustable bent housing described is much improved in strength to the prior art adjustable bent housings. The adjustable bent housing is as stiff as the rest of the drilling motor and is stronger in tension than previous designs. The threaded connections used for adjustment can be tightened to the same torque as the rest of the connections in the motor, while retaining a positive indexing capacity. It will also be apparent to one skilled in the art that modifications may be made to the described and illustrated embodiment without departing from the spirit and scope of the invention as defined by the claims.

The embodiments of the invention in which an exclusive property or privilege is claimed are defined as follows:

1. An adjustable bent housing comprising:

a. three tubular members arranged in end to end relation, each of the tubular members having an interior bore, the tubular members comprising;

i. a first tubular member having a first axis, ii. a second tubular member having a second axis, iii. a central tubular member centrally disposed between the first tubular member and the second tubular member and having a third axis, the first axis and the second axis being offset from the third axis such that adjustment is effected by rotating at least one of the first tubular member and the second tubular member in order to alter the positioning of the first axis or the second axis relative to the third axis, b. an internal tubular member extending into and engaging the interior bores of the three tubular members thereby maintaining the tubular members in end to end relation with the axes in a predetermined relative position;

c. the internal tubular member having an external surface, a first end and a second end, a spline extending radially outwardly from the external surface intermediate the first end and the second end and threads on the external surface adjacent the first end and the second end, the threads at one of the first end and the second end being offset;

d. the first tubular member having a first end face and an interior bore, the interior bore having interior threads adjacent the first end face such that the first tubular member is adapted to threadedly engage the first end of the internal tubular member;

e. the second tubular member having a second end face and an interior bore, the interior bore having interior threads adjacent the second end face such that the second tubular member is adapted to threadedly engage the second end of the internal tubular member;

f. the central tubular member having an interior bore, a first end and a second end, the central tubular member telescopically receiving and being axially moveable between the first end and the second end of the internal tubular member, the interior bore having a spline extending radially inwardly, such that the spline mates with the spline on the exterior surface of the internal tubular member to non-rotatably couple the internal tubular member with the central tubular member, at least one of the ends of the central tubular member having a mating clutch engagement with at least one of the first end of the first tubular member and the second end of the second tubular member.

* * * * *